US009213260B1

(12) United States Patent
Shigezaki et al.

(10) Patent No.: US 9,213,260 B1
(45) Date of Patent: Dec. 15, 2015

(54) IMAGE FORMING APPARATUS FOR SUPPRESSING NON-UNIFORMITY OF AN IMAGE CAUSED BY A DIFFERENCE IN TONER PARTICLE DIAMETER

(71) Applicant: FUJI XEROX CO., LTD, Minato-ku, Tokyo (JP)

(72) Inventors: Satoshi Shigezaki, Kanagawa (JP); Sho Watanabe, Kanagawa (JP)

(73) Assignee: FUJI XEROX CO., LTD, Tokyo (JP)

( * ) Notice: Subject to any disclaimer, the term of this patent is extended or adjusted under 35 U.S.C. 154(b) by 0 days.

(21) Appl. No.: 14/521,997

(22) Filed: Oct. 23, 2014

(30) Foreign Application Priority Data

Jun. 23, 2014 (JP) ..... 2014-128498

(51) Int. Cl.
*G03G 15/08* (2006.01)
*G03G 15/01* (2006.01)
*G03G 15/00* (2006.01)

(52) U.S. Cl.
CPC ..... *G03G 15/0831* (2013.01); *G03G 15/01* (2013.01); *G03G 15/6585* (2013.01)

(58) Field of Classification Search
CPC ..... G03G 15/6858; G03G 15/0831; G03G 15/01; G03G 15/6585
USPC ..... 399/40, 39, 53, 54
See application file for complete search history.

(56) References Cited

U.S. PATENT DOCUMENTS 5,915,144 A 6/1999 Ide et al.
2014/0255053 A1* 9/2014 Ohshika ..... 399/53

FOREIGN PATENT DOCUMENTS

JP 11-7174 A 1/1999
JP 2011-174970 A 9/2011
JP 2013-072969 A 4/2013

* cited by examiner

*Primary Examiner* — Billy Lactaoen
(74) *Attorney, Agent, or Firm* — Sughrue Mion, PLLC

(57) ABSTRACT

Provided is an image forming apparatus, including a first image portion that uses a first toner, and a second image portion that uses a second toner having a particle diameter greater than a particle diameter of the first toner, wherein, in a case where a first image of the first image portion is formed on a recording medium and a second image of the second image portion is formed on the first image, as compared to a case where only the first image is formed on the recording medium, an amount of the first toner per unit area of the first image increases.

10 Claims, 7 Drawing Sheets

CONTROL PORTION
70
10
12
H
W
30V
28V
30Y
28Y
30M
28M
30C
28C
30K
28K
40V
46V
40Y
46Y
40M
46M
40C
46C
40K
46K
52V
52Y
52M
52C
52K
50
56
54
16
32
34
60
62

FIG. 2

| | VOLUME AVERAGE PARTICLE DIAMETER OF BASIC TONER | VOLUME AVERAGE PARTICLE DIAMETER OF CLEAR TONER | DEVELOPING AMOUNT OF BASIC TONER | EVALUATION OF NONUNIFORMITY OF IMAGE |
|---|---|---|---|---|
| EXAMPLE 1 | 3.9 μm | 5.4 μm | 3.2g/m² | ○ |
| EXAMPLE 2 | | 6.5 μm | 3.7g/m² | ○ |
| COMPARATIVE EXAMPLE 1 | | 3.9 μm | 2.7g/m² | ○ |
| COMPARATIVE EXAMPLE 2 | | 5.4 μm | 2.7g/m² | × |
| COMPARATIVE EXAMPLE 3 | | 6.5 μm | 2.7g/m² | × × |

IMAGE FORMING APPARATUS FOR SUPPRESSING NON-UNIFORMITY OF AN IMAGE CAUSED BY A DIFFERENCE IN TONER PARTICLE DIAMETER

CROSS-REFERENCE TO RELATED APPLICATIONS

This application is based on and claims priority under 35 USC 119 from Japanese Patent Application No. 2014-128498 filed Jun. 23, 2014.

BACKGROUND

Technical Field

The present invention relates to an image forming apparatus.

SUMMARY

According to an aspect of the invention, there is provided an image forming apparatus, including:

a first image portion that uses a first toner; and a second image portion that uses a second toner having a particle diameter greater than a particle diameter of the first toner, wherein, in a case where a first image of the first image portion is formed on a recording medium and a second image of the second image portion is formed on the first image, as compared to a case where only the first image is formed on the recording medium, an amount of the first toner per unit area of the first image increases.

BRIEF DESCRIPTION OF THE DRAWINGS

Exemplary embodiments of the present invention will be described in detail based on the following figures, wherein:

FIG. 2 is a drawing illustrating an evaluation result of the image forming apparatus according to the exemplary embodiment of the present invention, as a table;

DETAILED DESCRIPTION

An example of an image forming apparatus according to an exemplary embodiment of the present invention will be described with reference to FIGS. 1 to 7. In addition, an arrow H illustrated in each drawing is a vertical direction and illustrates an apparatus up-and-down direction. An arrow W is a horizontal direction and illustrates an apparatus width direction.

Entire Configuration of Image Forming Apparatus

Figure 7:
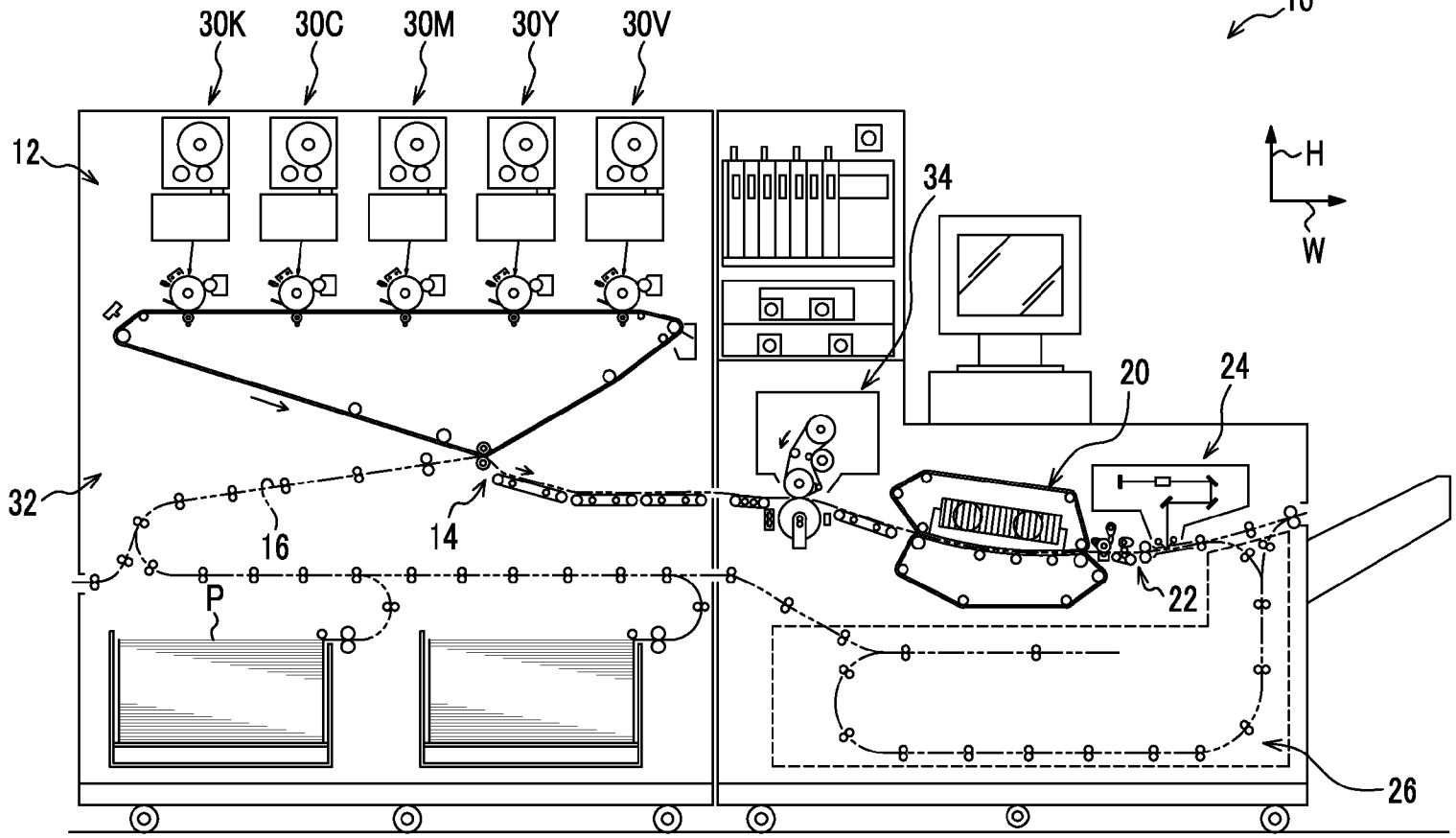
FIG. 7 is a configuration view illustrating the image forming apparatus according to the exemplary embodiment of the present invention.

As illustrated in FIG. 7, an image forming apparatus 10 includes: an image forming portion 12 which forms an image by an electrophotographic process; and plural transporting members (reference numeral is omitted) which transports a sheet member P (an example of a recording medium) on which an image is formed along a transporting path 16 of the sheet member P.

In addition, the image forming apparatus 10 includes: a cooling portion 20 which cools the sheet member P on which the image is formed; a correction portion 22 which corrects a curve of the sheet member P; and an image inspection portion 24 which inspects the image formed on the sheet member P.

Furthermore, since the image is formed on both surfaces of the sheet member P, the image forming apparatus 10 is provided with a reverse route 26 for reversing the sheet member P on the front surface of which the image is formed and transporting the sheet member P toward the image forming portion 12 again.

In the image forming apparatus 10 according to the above-described configuration, the image (toner image) formed by the image forming portion 12 is formed on the front surface of the sheet member P transported along the transporting path 16. Furthermore, the sheet member P on which the image is formed is output to the outside of the apparatus through the cooling portion 20, the correction portion 22, and the image inspection portion 24 in order.

Meanwhile, when an image is formed on a rear surface of the sheet member P, the sheet member P on the front surface of which the image is formed is transported along the reverse route 26, and the image is formed on the rear surface of the sheet member P by the image forming portion 12 again.

Image Forming Portion

The image forming portion 12 includes: plural toner image forming portions 30 which form toner images of each color, respectively; and a transfer portion 32 which transfers the toner image formed by the toner image forming portion 30 to the sheet member P. Furthermore, the image forming portion 12 is provided with a fixing device 34 which fixes the toner image transferred to the sheet member P by the transfer portion 32, onto the sheet member P.

The plural toner image forming portions 30 are provided to form the toner images for every color. In the exemplary embodiment, the toner image forming portions 30 for total five colors, such as a special color (V), yellow (Y), magenta (M), cyan (C), and black (K) are provided. (V), (Y), (M), (C), and (K) illustrated in FIG. 7 illustrate each of the above-described colors. In the exemplary embodiment, the special color (V) is a transparent (hereinafter, referred to as a "transparent (V)") which gives the image a glossiness. Yellow (Y), magenta (M), cyan (C), and black (K) are basic colors for outputting a color image. In addition, in the following description, when it is not necessary to distinguish the special color (V), yellow (Y), magenta (M), cyan (C), and black (K), V, Y, M, C, and K which are referenced by the reference numerals will be omitted.

Figure 6:
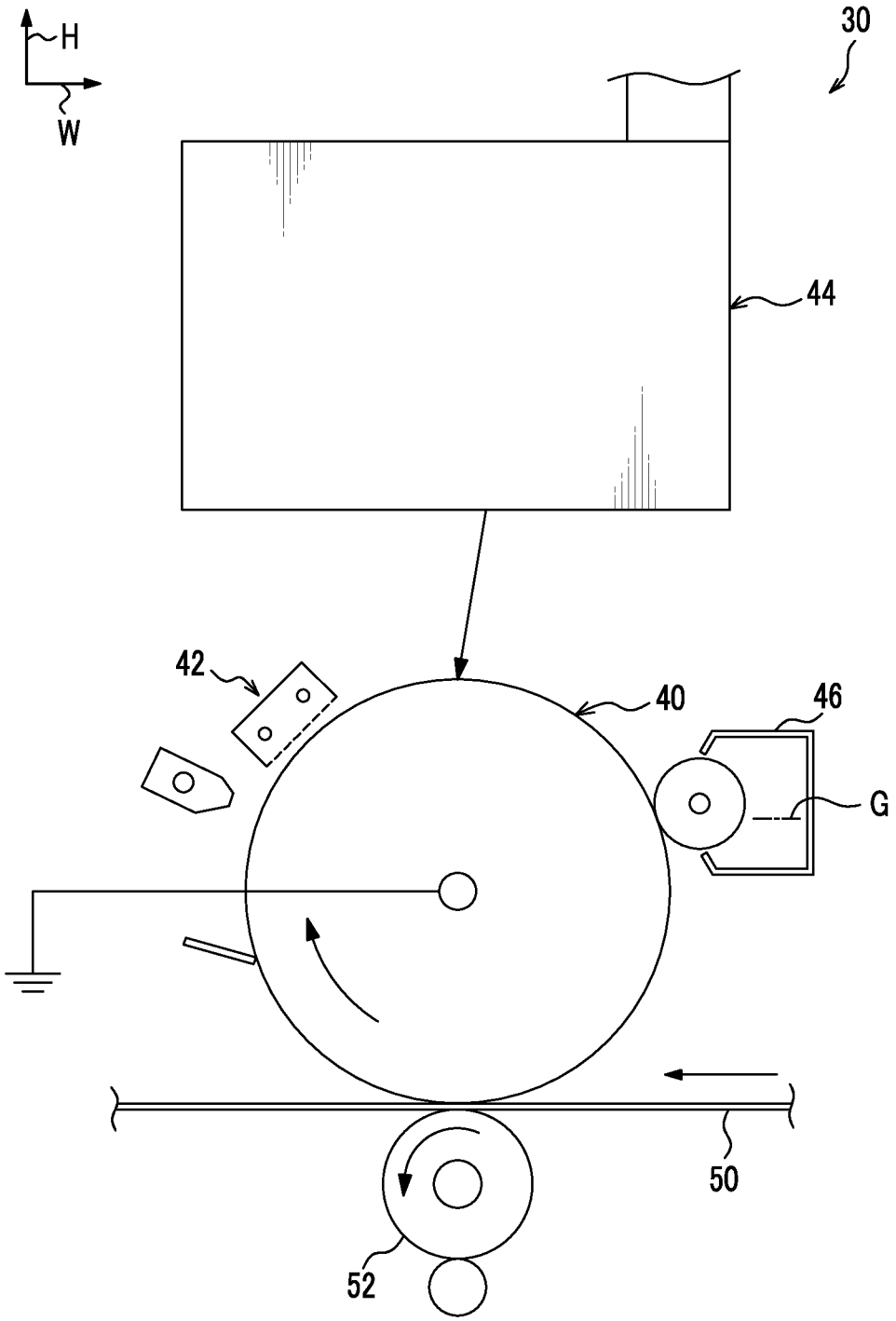
FIG. 6 is a configuration view illustrating a toner image forming portion of the image forming apparatus according to the exemplary embodiment of the present invention.

The toner image forming portions 30 of each color are configured basically in a similar manner except for the toner which is used, and as illustrated in FIG. 6, are provided with a rotating cylindrical image holding member 40 and a charging device 42 which charges the image holding member 40. Furthermore, the toner image forming portion 30 is provided with an exposure device 44 which forms an electrostatic latent image by irradiating the charged image holding member 40 with exposure light and a developing device 46 which develops the electrostatic latent image as the toner image by a developer G including a toner.

Figure 1:
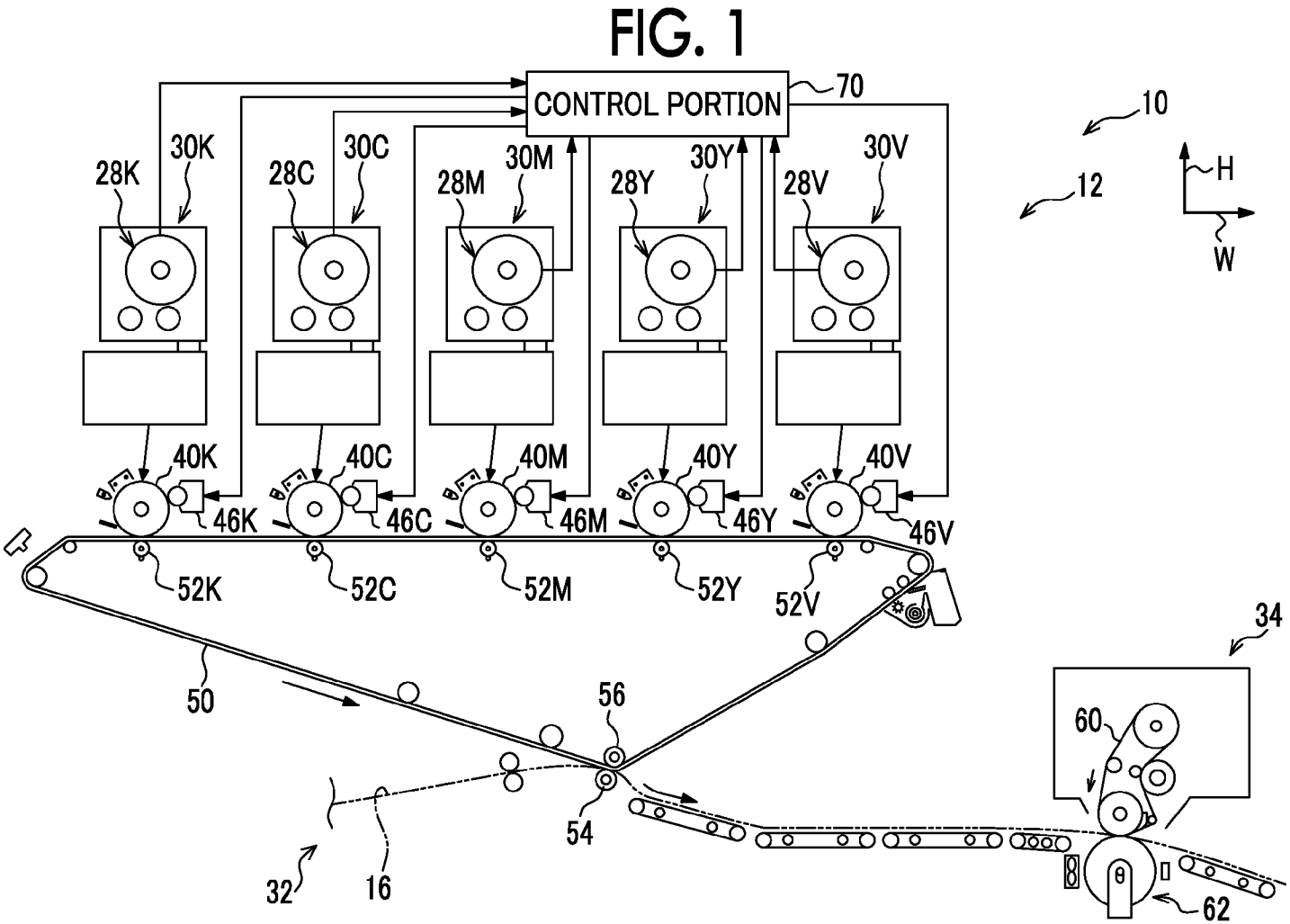
FIG. 1 is a configuration view illustrating an image forming portion of an image forming apparatus according to an exemplary embodiment of the present invention.

In addition, the image holding members 40 of each color come into contact with a transfer belt 50 (to be described in detail later) which circulates and moves. As illustrated in FIG. 1, in a circulating direction (refer to the arrow in the drawing) of the transfer belt 50, the toner image forming portions 30 of the transparent (V), yellow (Y), magenta (M), cyan (C), and black (K) are disposed to be aligned in the horizontal direction in order from an upstream side.

In the toner image forming portions 30 of Y, M, C, and K (an example of a first image portion), the images of yellow (Y), magenta (M), cyan (C), and black (K) (examples of the basic color) are formed by using a basic toner T1 (refer to FIGS. 4A and 4B) of yellow (Y), magenta (M), cyan (C), and black (K).

In contrast, in a toner image forming portion 30V (an example of a second image forming portion), an image of a transparent (V) (an example of the special color) is formed by using a clear toner T2 (an example of a special toner).

The transfer portion 32 is provided with the transfer belt 50 which circulates, overlaps the toner image formed with the image holding members 40 of each color, and transfers the overlapped image to the sheet member P. In addition, the transfer portion 32 will be described in detail later.

As illustrated in FIG. 1, the fixing device 34 is rolled by plural rollers (reference numeral is omitted), and is provided with a heated fixing belt 60 and a pressure roller 62 which applies pressure to the sheet member P toward the fixing belt 60.

In this configuration, by the circulating fixing belt 60 and the pressure roller 62, the sheet member P to which the toner image is transferred is nipped. Accordingly, the toner image is fixed onto the sheet member P.

Main Portion Configuration

Next, the developing device 46 of the toner image forming portion 30, a toner cartridge 28, the particle diameter (volume average particle diameter) of the toner which is used in the developing device 46, the transfer portion 32, and a control portion 70 which controls the developing device 46 will be described.

Developing Device

The developing device 46 develops the electrostatic latent image which is formed on an outer circumferential surface of the image holding member 40 by a toner T included in the developer G as the toner image (refer to FIG. 6).

The volume average particle diameter of the basic toner T1 which is used for the basic colors of yellow (Y), magenta (M), cyan (C), and black (K) is 3.9 μm. Meanwhile, the volume average particle diameter of the clear toner T2 which is used for the transparent (V) is 5.4 μm.

In addition, the particle diameter is measured by using a particle size distribution measuring device (Coulter Multisizer II: manufactured by Beckman Coulter) as a measuring device of the volume average particle diameter of the toner T, and an ISOTON-II (manufactured by Beckman Coulter) as an electrolyte. As a measuring method, 0.5 mg to 50 mg of a measurement sample is added to a surfactant as a dispersing agent, preferably 2 ml of a 5% aqueous solution of sodium alkylbenzene sulfonate, and this is added into 100 ml to 150 ml of electrolyte solution. The electrolyte solution in which the measurement sample is suspended is subjected to dispersion processing for approximately one minute by an ultrasonic diffuser, and the particle size distribution is measured by using the aperture of a Coulter Multisizer II type with an aperture diameter of 100 μm. The number of particles to be measured is 50,000. Regarding the measured particle size distribution, a cumulative distribution is drawn from a small-diameter side with respect to a divided particle size range (channel), the particle diameter which takes 50% of the accumulation in volume is defined as a volume average particle diameter D50v, and the D50v is the volume average particle diameter.

In addition, as illustrated in FIG. 1, the image forming portion 12 is connected with the developing devices 46 of each color via a supply tube (not illustrated), and is provided with the toner cartridges 28 of each color for supplying the toner T to the developing devices 46 of each color.

Toner Cartridge

The toner cartridge 28 accommodates the toner T inside thereof, and may be detachable from a main body of the apparatus. In addition, a chip (not illustrated) to which information, such as the color of the toner T accommodated inside or the volume average particle diameter of the toner T, is input is attached to the toner cartridge 28.

Transfer Portion

As illustrated in FIG. 1, the transfer portion 32 includes: the transfer belt 50 which is rolled by the plural rollers (reference numeral is omitted) and circulates in the arrow direction in the drawing; and first transfer rollers 52 of each color which transfer the toner images formed on the image holding members 40 of each color to the transfer belt 50. Furthermore, the transfer portion 32 includes: a roller 56 which is rolled by the transfer belt 50; and a second transfer roller 54 which is disposed on a side opposite to the roller 56 with respect to the transfer belt 50 and transfers the toner image transferred to the transfer belt 50, to the sheet member P.

In this configuration, the toner images formed by the toner image forming portions 30 of each color is firstly transferred by the first transfer roller 52 to the circulating transfer belt 50. Furthermore, the toner image which is firstly transferred to the transfer belt 50 is secondarily transferred to the sheet member P by the second transfer roller 54.

Here, the toner image is overlapped on the transfer belt 50 and firstly transferred in the order of the transparent (V), yellow (Y), magenta (M), cyan (C), and black (K). In addition, in a state where the toner image overlapped in this manner is secondarily transferred to the sheet member P, the order of overlapping is reversed, and the toner image is overlapped on the sheet member P and secondarily transferred in the order of black (K), cyan (C), magenta (M), yellow (Y), and the transparent (V).

In other words, basic color images (an example of the first image) of each basic color, such as black (K), cyan (C), magenta (M), and yellow (Y), are formed on the sheet member P, and a clear image (an example of the second image) of the transparent (V) is formed on the basic color image.

Control Portion

As illustrated in FIG. 1, the control portion 70 controls the developing devices 46 of each color.

In particular, there are a case where the clear toner T2 having a volume average particle diameter larger than that of the basic toner T1 is used, and the basic color image and the clear image are formed on the sheet member P in order, and a case where only the basic color image is formed on the sheet member P by the basic toner T1.

The control portion 70 acquires information on the volume average particle diameter of the toner T from the chip attached to the toner cartridges 28 of each color. Then, in a case where the clear toner T2 having a volume average particle diameter larger than that of the basic toner T1 is used, and the basic color image and the clear image are formed on the sheet member P in order, compared to a case where only the basic color image is formed on the sheet member P, the control portion 70 increases the developing amount (basic toner amount per unit area) of the basic color image. More specifically, the control portion 70 controls a developing bias, and increases a developing amount of all of the basic color images, respectively.

In the exemplary embodiment, as described above, the volume average particle diameter of the basic toner T1 is 3.9 μm, and the volume average particle diameter of the clear toner T2 is 5.4 μm. Furthermore, the basic color image is formed on a sheet member, and the clear image is formed on the basic color image. For this reason, in a case where the basic color image and the clear image are formed on the sheet member, compared to a case where only the basic color image is formed on the sheet member P, the control portion 70 increases the developing amount of the basic color image.

Others

Next, the toner image which is formed on the sheet member P by the image forming apparatus 10 according to the exemplary embodiment, and the toner image which is formed on the sheet member P by the image forming apparatus according to the comparative embodiment with respect to the exemplary embodiment, will be described with reference to FIGS. 4A to 5B. In addition, in FIGS. 4A and 5A, the size of the basic toner T1 which constitutes the basic color image (magenta image) and the size of the clear toner T2 which constitutes the clear image are illustrated to be exaggerated so that the difference in the size is easily understood.

First, the toner image which is formed on the sheet member P by the image forming apparatus according to the comparative embodiment will be described with reference to FIGS. 5A and 5B.

The image forming apparatus according to the comparative embodiment operates a toner image forming portion 30M and the toner image forming portion 30V, and outputs a magenta image having glossiness onto the sheet member P. In addition, the developing amount of the basic color image (magenta image) is similar to a case where only the basic color image is formed on the sheet member P.

Figure 5A:
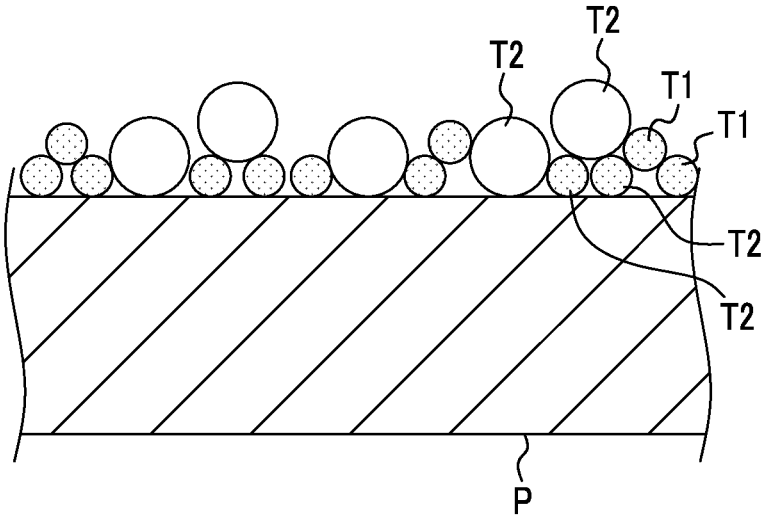
FIGS. 5A and 5B are cross-sectional views illustrating the toner image output by using an image forming apparatus according to a comparative embodiment with respect to the exemplary embodiment of the present invention.

In FIG. 5A, the basic color image is formed on the sheet member P, and the clear image is formed on the basic color image, and further, a state before the basic color image and the clear image are fixed onto the sheet member P is illustrated as a cross section. As illustrated in FIG. 5A, the clear toner T2 having a volume average particle diameter of 5.4 μm pushes the basic toner T1 having a volume average particle diameter of 3.9 μm aside, and comes into contact with a front surface of the sheet member P.

Figure 5B:
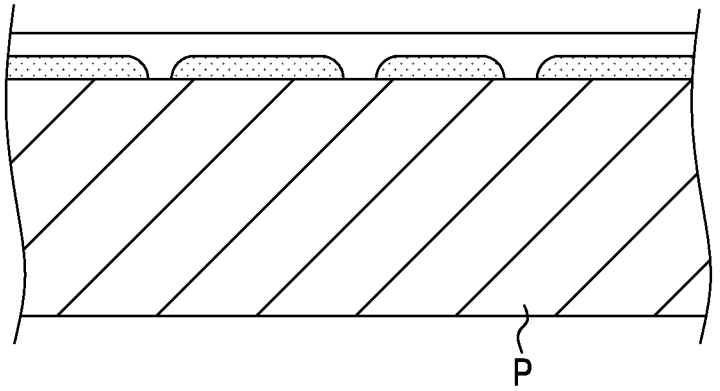

In addition, in FIG. 5B, a state where the basic color image and the clear image are fixed onto the sheet member P is illustrated as a cross section. As illustrated in FIG. 5B, in a state where the basic color image and the clear image are fixed onto the sheet member P, a part of the clear image is in contact with the sheet member P. For this reason, a nonuniformity of image is generated on the output toner image.

In addition, when the toner image forming portion 30M is operated and the toner image forming portion 30V is not operated, the clear toner T2 does not push the basic toner T1 aside. For this reason, the generation of the nonuniformity of image on the toner image is suppressed.

Next, the toner image which is formed on the sheet member P by the image forming apparatus 10 according to the exemplary embodiment will be described with reference to FIGS. 4A and 4B.

In the image forming apparatus 10 according to the exemplary embodiment, with respect to the image forming apparatus according to the comparative embodiment, the developing amount of the magenta image (basic color image) increases. In other words, compared to a case where only the basic color image is formed on the sheet member P, the developing amount of the basic color image (magenta image) is greater. Other characteristics are similar to the image forming apparatus according to the comparative embodiment.

Figure 4A:
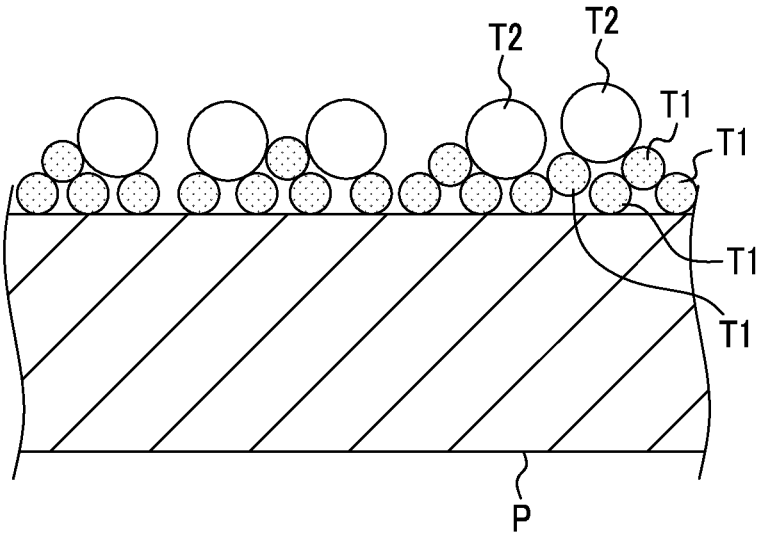
FIGS. 4A and 4B are cross-sectional views illustrating a toner image output by using the image forming apparatus according to the exemplary embodiment of the present invention.

In FIG. 4A, a state where the basic color image is formed on the sheet member P and the clear image is formed on the basic color image, and further a state before the basic color image and the clear image are fixed onto the sheet member P, are illustrated as a cross section. As illustrated in FIG. 4A, the developing amount of the magenta image increases compared to the comparative embodiment. For this reason, even when the clear toner T2 pushes the basic toner T1 aside, the contact of the clear toner T2 with the front surface of the sheet member P is suppressed.

Figure 4B:
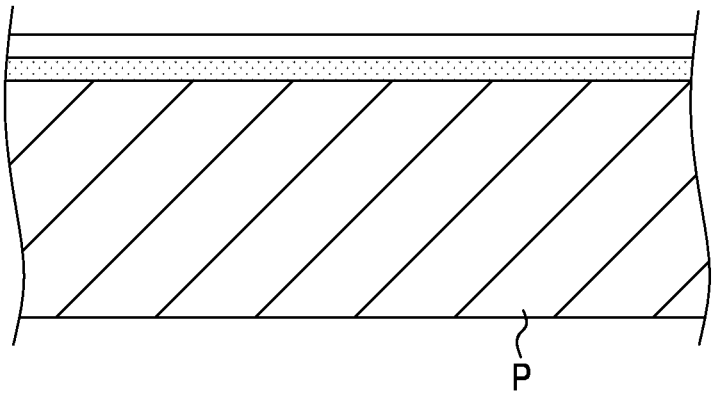

In addition, in FIG. 4B, a state where the basic color image and the clear image are fixed onto the sheet member P is illustrated as a cross section. As illustrated in FIG. 4B, in a state where the basic color image and the clear image are fixed onto the sheet member P, the contact of the clear image with the sheet member P is suppressed. For this reason, the generation of the nonuniformity of image caused by the output toner image is suppressed.

As described above, in the toner image which is formed by the image forming apparatus according to the comparative embodiment, the nonuniformity of image is generated, and in the toner image which is formed by the image forming apparatus 10 according to the exemplary embodiment, the generation of the nonuniformity of image is suppressed. The nonuniformity of image is generated by a deterioration of a coverage ratio (a ratio of covering the sheet member P) of the basic toner T1 with respect to the sheet member P. In other words, the nonuniformity of image is generated when the coverage ratio decreases, and the generation of the nonuniformity of image is suppressed when the coverage ratio increases.

Next, a relationship between the coverage ratio of the basic toner T1 and the developing amount of the basic toner T1 with respect to the sheet member P in a case where the basic color image and the clear image are formed on the sheet member P in order, will be described by using a graph illustrated in FIG. 3.

Figure 3:
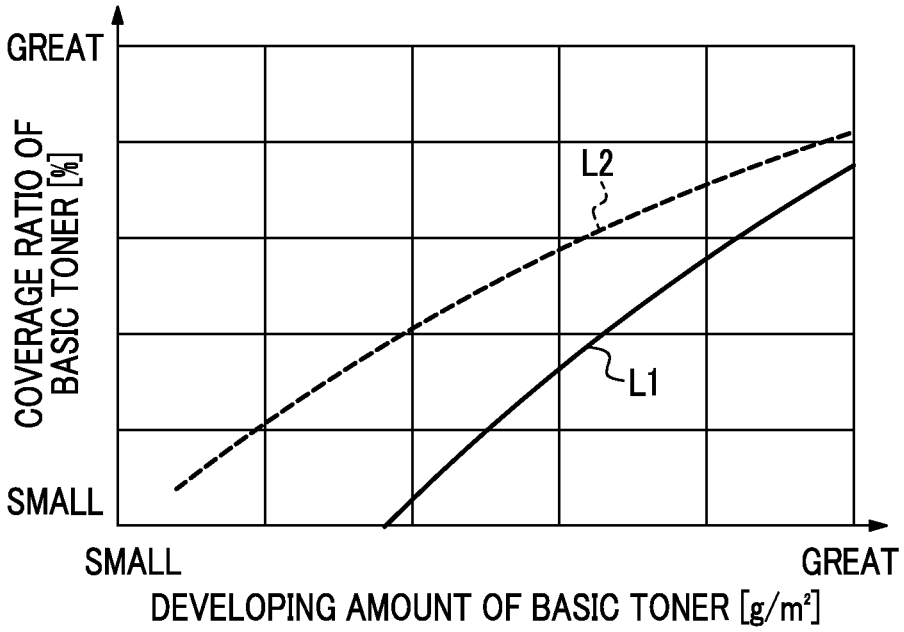
FIG. 3 is a drawing illustrating a graph regarding a relationship between a coverage ratio of a basic toner and a developing amount of the basic toner in the image forming apparatus according to the exemplary embodiment of the present invention.

A vertical axis of the graph illustrated in FIG. 3 is the coverage ratio (%) of the basic toner T1, and the horizontal axis of the graph illustrated in FIG. 3 is the developing amount ($g/m^2$) of the basic toner T1.

In addition, a solid line L1 in the graph illustrates the relationship between the coverage ratio and the developing amount in a case where the volume average particle diameter of the clear toner T2 of an upper layer is 5.4 μm and the volume average particle diameter of the basic toner T1 of a lower layer is 3.9 μm. In addition, the developing amount of the clear toner T2 is an amount determined in advance.

Furthermore, a dotted line L2 in the graph illustrates the relationship between the coverage ratio and the developing amount in a case where the volume average particle diameter of the clear toner T2 of the upper layer is 3.9 μm and the volume average particle diameter of the basic toner T1 of a lower layer is 3.9 μm. In addition, the developing amount of the clear toner T2 is an amount determined in advance similarly to the solid line L1.

In this manner, in the solid line L1 and the dotted line L2, only the volume average particle diameter of the clear toner T2 of the upper layer is different.

From the graph of FIG. 3, it is found that the coverage ratio of the basic toner T1 increases when the developing amount of the basic toner T1 increases. In addition, it is found that, in a case where the volume average particle diameter of the clear toner T2 is greater than the volume average particle diameter of the basic toner T1 (solid line L1), compared to a case where the volume average particle diameter of the basic toner T1 and the volume average particle diameter of the clear toner T2 are similar to each other (dotted line L2), the coverage ratio of the basic toner T1 deteriorates.

In addition, regarding the order of calculating the coverage ratio of the basic toner T1, first, by using a digital microscope (Keyence VHX-1000, 175x), the toner image on the sheet member P is input as image data. Furthermore, by performing a color separation and a binarization process with respect to the image data by using an image processing analysis software, the coverage ratio of the basic toner T1 is calculated. In a case of the above-described coverage ratio, by extracting a magenta component of the basic toner T1 by the color separation and performing the binarization process, the coverage ratio (%) of the magenta component is calculated.

In addition, regarding the order of calculating the developing amount of the basic toner T1, first, a single color image patch (for example, 20 mm×20 mm) of 100% of image coverage is transferred to the sheet member P. Then, the sheet member P which is in a state before the single color image patch is fixed onto the sheet member P is output from the image forming apparatus. Next, by using an absorption device having a filter, an unfixed toner on the sheet member P is absorbed and returned, and a mass of the toner returned to the filter is measured. As the mass is divided by an image patch area, the developing amount ($g/m^2$) is calculated.

Evaluation

Next, regarding examples and comparative examples according to the exemplary embodiment, the nonuniformity of image is evaluated by using a Color 1000 Press manufactured by Fuji Xerox Co., Ltd.

Evaluation Specification

Hereinafter, evaluation specifications will be described (refer to FIG. 2).

In addition, regarding all of the evaluation specifications, the developing amount of the basic toner T1 in a case where the clear toner T2 is not used is 2.7 $g/m^2$.

1. Example 1

The volume average particle diameter of the basic toner T1 is 3.9 μm.

The volume average particle diameter of the clear toner T2 is 5.4 μm.

The developing amount of the basic toner T1 is 3.2 $g/m^2$.

2. Example 2

The volume average particle diameter of the basic toner T1 is 3.9 μm.

The volume average particle diameter of the clear toner T2 is 6.5 μm.

The developing amount of the basic toner T1 is 3.7 $g/m^2$.

3. Comparative Example 1

The volume average particle diameter of the basic toner T1 is 3.9 μm.

The volume average particle diameter of the clear toner T2 is 3.9 μm.

The developing amount of the basic toner T1 is 2.7 $g/m^2$.

4. Comparative Example 2

The volume average particle diameter of the basic toner T1 is 3.9 μm.

The volume average particle diameter of the clear toner T2 is 5.4 μm.

The developing amount of the basic toner T1 is 2.7 $g/m^2$.

5. Comparative Example 3

The volume average particle diameter of the basic toner T1 is 3.9 μm.

The volume average particle diameter of the clear toner T2 is 6.5 μm.

The developing amount of the basic toner T1 is 2.7 $g/m^2$.

As described above, regarding the examples 1 and 2, the volume average particle diameter of the clear toner T2 is set to be greater than the volume average particle diameter of the basic toner T1, and the developing amount of the basic toner T1 is set to be greater than the developing amount of the basic toner T1 of a case where the clear toner T2 is not used.

Meanwhile, regarding the comparative example 1, the volume average particle diameter of the clear toner T2 is set to be similar to the volume average particle diameter of the basic toner T1. In addition, regarding the comparative examples 2 and 3, regardless that the volume average particle diameter of the clear toner T2 is set to be greater than the volume average particle diameter of the basic toner T1, the developing amount of the basic toner T1 is set to be similar to the developing amount of the basic toner T1 of a case where the clear toner T2 is not used.

In addition, all of the specifications which are not described above are similar throughout the examples 1 and 2, and the comparative examples 1 to 3.

Evaluation Method

1. A paper sheet J (manufactured by Fuji Xerox InterField Co., Ltd., a basis weight is 82 $g/m^2$) is used as the sheet member P in the evaluation. Regarding each specification, the toner image is formed on 5 paper sheets J, and the toner images formed on the 5 sheet members P are evaluated.

2. The toner image is set to be a patch having a size of 20 mm×20 mm on the sheet member P. At this time, the basic color image is formed on the sheet member P, and the clear image is formed on the basic color image.

The developing amount of the basic color image is set to be the above-described value, and the developing amount of the clear image is set to be a value at which the clear image has 100% of the image coverage.

Evaluation Result

A case where the toner image formed on the sheet member P is visually observed and the nonuniformity of image is not generated, or a case where the level of the nonuniformity of image is allowable by a user even when the nonuniformity of image is generated, is "O". A case where the level of the nonuniformity of image is not allowable by a small number of users is "X". Furthermore, a case where the level of the nonuniformity of image is not allowable by a great number of users is "XX".

As illustrated in the table of FIG. 2, the examples 1 and 2, and the comparative example 1 are "0", the comparative example 2 is "X", and the comparative example 3 is "XX".

Consideration

Regarding the comparative example 1, the result is "0" since the volume average particle diameter of the clear toner T2 is set to be similar to the volume average particle diameter of the basic toner T1. Regarding the comparative examples 2 and 3, regardless that the volume average particle diameter of the clear toner T2 is greater than the volume average particle diameter of the basic toner T1, since the developing amount of the basic toner T1 is set to be similar to the developing amount of the basic toner T1 of a case where the clear toner T2 is not used, the results are "X" and "XX". Even from this result, by increasing the volume average particle diameter of the clear toner T2 with respect to the volume average particle diameter of the basic toner T1, it is found that the nonuniformity of image is generated on the toner image.

Regarding the examples 1 and 2, as may be found by comparison with the comparative examples 2 and 4, as the volume average particle diameter of the clear toner T2 increased with respect to the volume average particle diameter of the basic toner T1, the developing amount of the basic toner T1 increased. For this reason, the result is "O".

Conclusion of Main Portion Configuration

In the exemplary embodiment, in a case where the clear toner 12 having a volume average particle diameter greater than that of the basic toner T1 is used, and the basic color image and the clear image are formed on the sheet member P in order, compared to a case where only the basic color image is formed on the sheet member P, the control portion 70 increases the developing amount of the basic color image.

For this reason, as may be found from the above-described evaluation result, the deterioration of quality (nonuniformity of image) of the output image caused by the difference in a toner particle diameter is suppressed.

In addition, a certain exemplary embodiment of the present invention is described in detail, but the present invention is not limited to the exemplary embodiment. It is apparent for those skilled in the art that other various exemplary embodiments within the scope of the present invention may be employed. For example, in the above-described exemplary embodiment, a tandem type image forming apparatus is used in the description, but a rotary type image forming apparatus may be used. Even in a case of the tandem type image forming apparatus, an image forming apparatus which directly transfers the image of the image holding member to the sheet member may be used.

In addition, in the above-described exemplary embodiment, a case where four colors, such as yellow (Y), magenta (M), cyan (C), and black (K), are used as the basic color, is described as an example, but only one (for example, black (K)) toner image forming portion of the basic color may be used.

In addition, in the above-described exemplary embodiment, the volume average particle diameter of the all of the basic toners T1 is set to be 3.9 μm, but the volume average particle diameter may be different between the basic toners T1. In this case, the clear toner T2 having a volume average particle diameter greater than that of the basic toner having the smallest volume average particle diameter among the basic toners T1, may be used.

In addition, in the above-described exemplary embodiment, the transparent is used as the special color. However, in order to widen a color gamut of the output image, for example, orange, green, or violet may be used as the special color.

In addition, in the above-described exemplary embodiment, the control portion 70 increases the developing amount of each of the basic color images of four colors, respectively. However, only the developing amount of magenta (M), cyan (C), and black (K) which has a noticeable nonuniformity of image may be increased.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus; comprising:

a first image portion configured to use a first toner;

a second image portion configured to use a second toner; and a controller, wherein the controller is configured to, in response to a particle diameter of the second toner being greater than a particle diameter of the first toner, control an amount of the first toner per unit area of a first image of the first image portion to be greater in a case where the first image is formed on a recording medium and a second image of the second image portion is formed on the first image, as compared to a case where the first image is formed on the recording medium without the second image being formed on the first image.

2. An image forming apparatus comprising:

a first image portion configured to use first toners having basic colors of yellow, magenta, cyan, and black, respectively;

a second image portion configured to use a second toner that has a color other than the basic colors; and a controller, wherein the controller is configured to, in response to a particle diameter of the second toner being greater than a particle diameter of one of the first toners having a smallest particle diameter among the first toners, control an amount of the one of the first toners per unit area of a first image of the first image portion to be greater in a case where the first image is formed on a recording medium and a second image of the second image portion is formed on the first image, as compared to a case where the first image is formed on the recording medium without the second image being formed on the first image.

3. The image forming apparatus according to claim 1, wherein a color of the second toner is selected from among transparent, orange, green, and violet.

4. The image forming apparatus according to claim 2, wherein a color of the second toner is selected from among transparent, orange, green, and violet.

5. An image forming apparatus comprising:

a first image portion configured to form a first image using a first toner that has one of basic colors of yellow, magenta, cyan, and black;

a second image portion configured to form a second image using a second toner that has a color other than the basic colors; and a controller, wherein the controller is configured to, in response to a volume average particle diameter of the second toner being greater than a volume average particle diameter of the first toner, control an amount of the first toner per unit area of the first image to be greater in a case where the first image is formed on a recording medium and the second image is formed on the first image, as compared to a case where the first image is formed on the recording medium without the second image being formed on the first image.

6. The image forming apparatus according to claim 5, wherein the second image that is formed using the second toner has a color selected from among transparent, orange, green, and violet.

7. The image forming apparatus according to claim 1, wherein the controller is configured to, in response to the particle diameter of the second toner not being greater than the particle diameter of the first toner, control the amount of the first toner per unit area of the first image to be substantially equal in the case where the first image is formed on the recording medium and the second image is formed on the first image, as compared to the case where the first image is formed on the recording medium without the second image being formed on the first image.

8. The image forming apparatus according to claim 1, wherein the average particle diameter of the first toner is about 3.9 μm, and wherein the average particle diameter of the second toner is between about 5.4 μm and 6.5 μm.

9. The image forming apparatus according to claim 8, wherein the controller is configured to, in response to the particle diameter of the second toner being greater than the particle diameter of the first toner, in the case where the first image is formed on the recording medium and the second image is formed on the first image, control the amount of the first toner per unit area of the first image to be between about 3.2 $g/m^2$ and about 3.7 $g/m^2$.

10. An image forming apparatus comprising:

a first image portion configured to use a first toner;

a second image portion configured to use a second toner; and a controller, wherein the controller is configured to, in response to a particle diameter of the second toner being greater than a particle diameter of the first toner, control an amount of the first toner per unit area of a first image of the first image portion to be greater in a case where the first image is formed on a recording medium and a second image of the second image portion is formed on the first image, as compared to a case where the first image is formed on the recording medium without the second image being formed on the first image, and wherein the controller is configured to, in response to the particle diameter of the second toner being greater than the particle diameter of the first toner, in the case where the first image is formed on the recording medium and the second image is formed on the first image, control the amount of the first toner per unit area of the first image to be between about 3.2 $g/m^2$ and about 3.7 $g/m^2$.

* * * * *